US005848489A

United States Patent [19]

Hartley et al.

[11] Patent Number: 5,848,489

[45] Date of Patent: Dec. 15, 1998

[54] FRAME WITH LEVEL INDICATOR

[76] Inventors: David E. Hartley; Marcia G. Hartley, both of P.O. Box 647, Libby, Mont. 59923

[21] Appl. No.: 813,452

[22] Filed: Mar. 10, 1997

[51] Int. Cl.[6] ..... B23B 49/00

[52] U.S. Cl. ..... 40/713; 33/333

[58] Field of Search ..... 40/713; 33/333, 33/370, 334

[56] References Cited

U.S. PATENT DOCUMENTS

| | | | |
|---|---|---|---|
| D. 243,301 | 2/1977 | Rav | D6/235 |
| D. 244,771 | 6/1977 | Bott | D12/193 |
| D. 358,492 | 5/1995 | Storey et al. | D6/303 |
| 586,120 | 7/1897 | Flynn | 40/713 |
| 824,525 | 6/1906 | Bonney | 33/333 |
| 1,490,220 | 6/1924 | Lawrence | 33/334 |
| 3,912,216 | 10/1975 | Gano | 248/475 R |
| 4,100,681 | 7/1978 | Hollander | 33/389 |
| 4,212,123 | 7/1980 | Robin | 40/713 |
| 4,944,094 | 7/1990 | Depiano et al. | 33/371 |
| 5,327,951 | 7/1994 | Pickle et al. | 40/713 X |

*Primary Examiner*—Cassandra H. Davis
*Attorney, Agent, or Firm*—David L. Volk

[57] ABSTRACT

A frame includes a hanging surface adapted to be adjacent a wall when the frame is hung, and a front surface generally opposite the hanging surface. A level indicator is recessed within the frame and is visible when viewing the front surface of the frame. A removable cover plate is configured to conceal the level indicator from view. In another embodiment, the level indicator is visible when looking upward at the frame from below the frame when the frame is hung on a wall.

2 Claims, 3 Drawing Sheets

FRAME WITH LEVEL INDICATOR

BACKGROUND OF THE INVENTION

1. Field of the Invention

The present invention relates to frames for pictures, certificates and the like, particularly to an improved frame with a level indicator.

2. Description of the Related Art

Framed pictures and certificates are used in any number of settings to decorate the walls and to "bring life" to a room. Those who hang framed pictures and certificates typically have difficulty determining if the frame is hung level on the wall. Usually the person hanging the frame must enlist the help of a second person who uses visual judgement to determine if the frame appears to be level.

What is needed is a frame which provides a true indication of whether it is hung level.

SUMMARY OF THE INVENTION

The frame of the present invention includes a hanging surface adapted to be adjacent a wall when the frame is hung, and a front surface generally opposite the hanging surface. A level indicator is recessed within the frame and is visible when viewing the front surface of the frame. A removable cover plate is configured to conceal the level indicator from view.

In another embodiment of the invention, the level indicator is only visible by looking upward at the frame from below the frame when the frame is hung on a wall.

DETAILED DESCRIPTION

Figure 1:
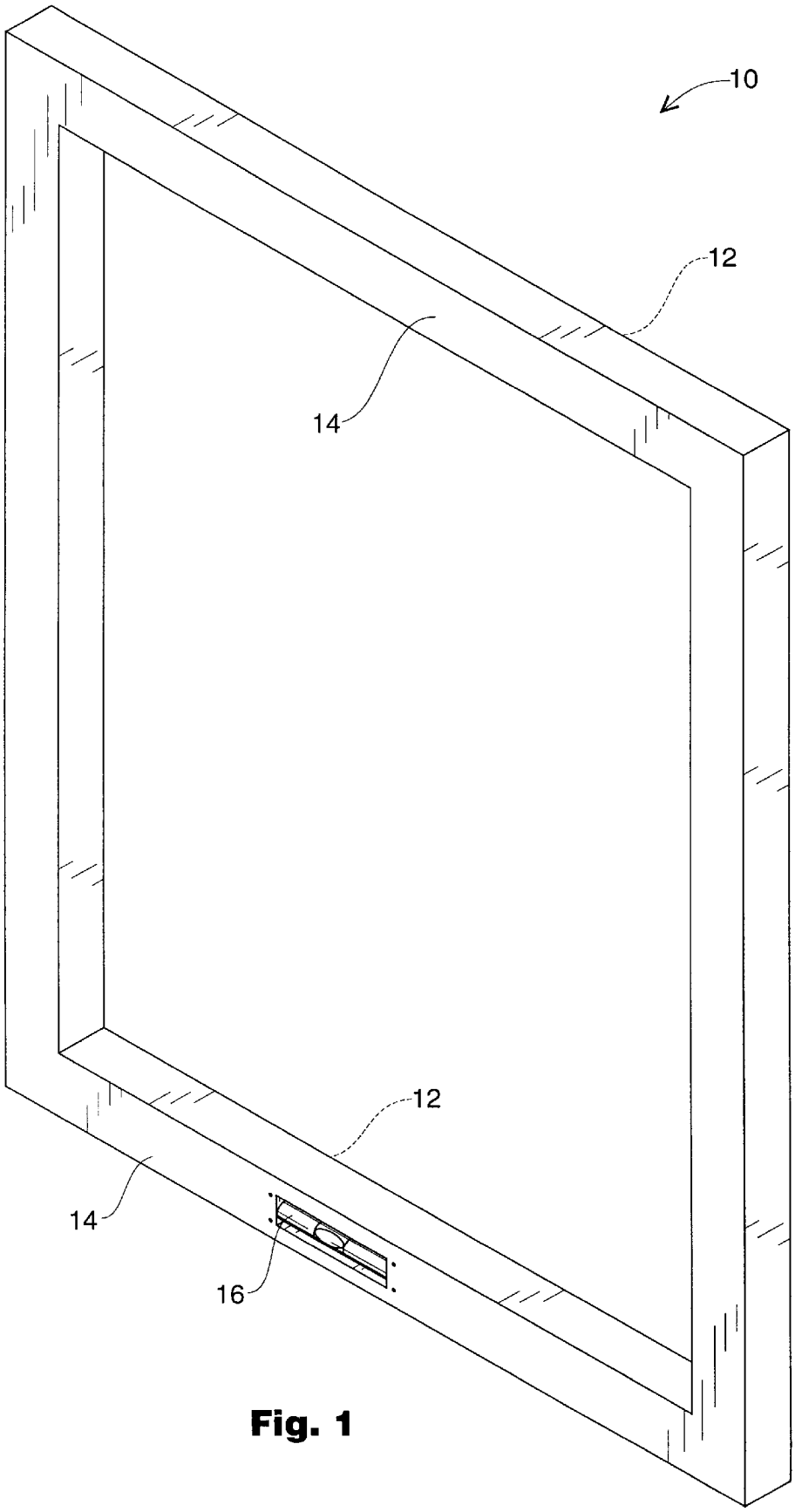
FIG. 1 is a perspective view of a frame.

FIG. 1 is a perspective view of a frame 10, shown in a generally vertical position as when hung on a vertical wall surface (not shown). The frame 10 includes a hanging surface 12 adapted to be adjacent a wall when the frame 10 is hung, and a front surface 14 which is disposed generally opposite the hanging surface 12. A level indicator 16 is recessed within the frame 10 and is visible when viewing the front surface 14 of the frame 10.

Figure 2:
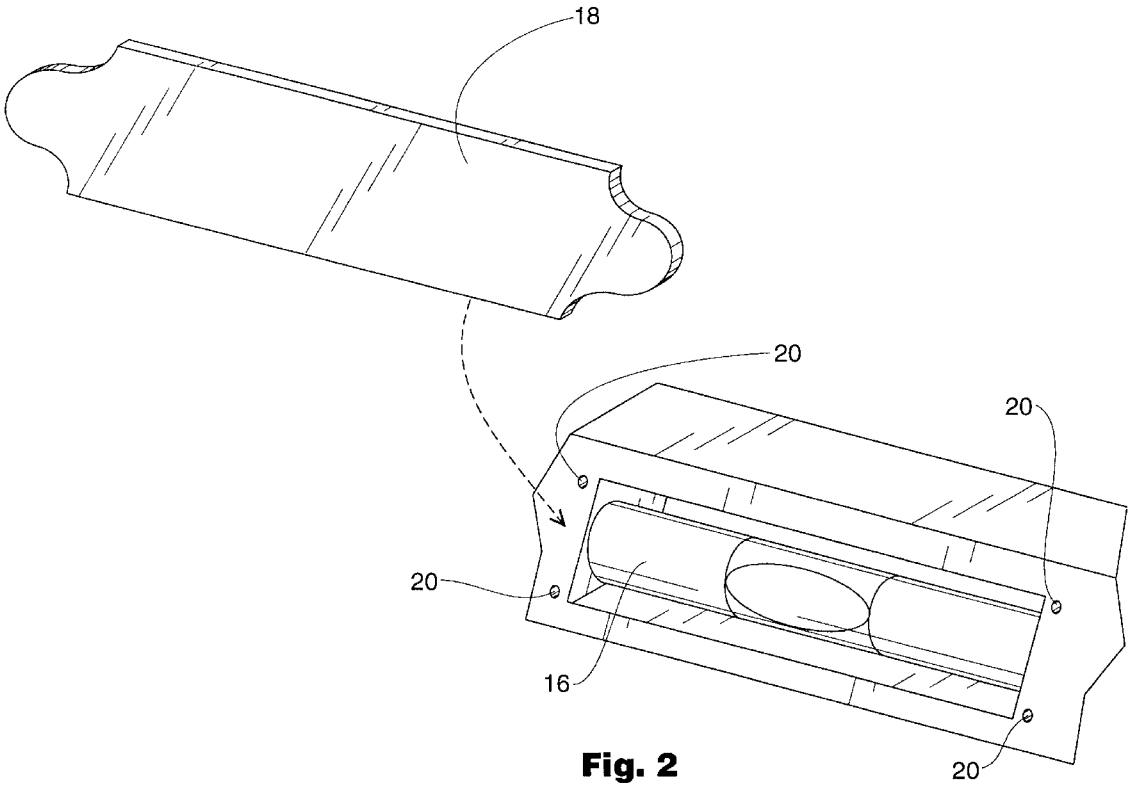
FIG. 2 is a partial perspective view of the level indicator and a removable cover plate.

FIG. 2 is a partial perspective view of the level indicator 16 and a removable cover plate 18. The removable cover plate 18 is configured to conceal the level indicator 16 from view.

Figure 2A:
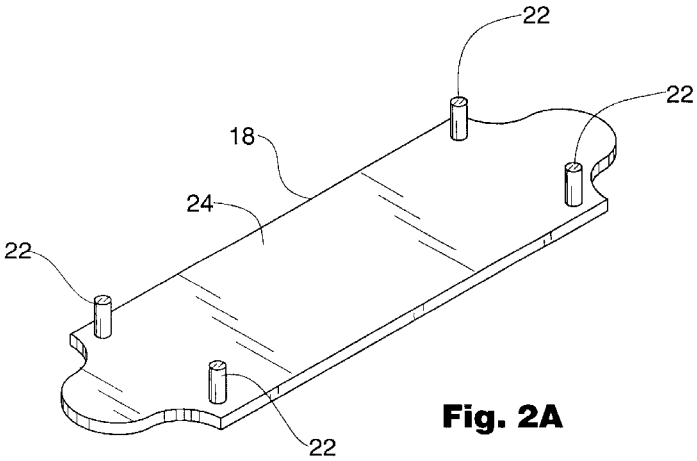
FIG. 2A is a rear perspective view of the cover plate.

FIG. 2A is a rear perspective view of the cover plate 18. Referring to FIGS. 2 and 2A, a plurality of peg receiving apertures 20 surround the level indicator 16. The cover plate 18 includes a plurality of pegs 22 on a rear surface 24 of the cover plate 18. The pegs 22 are positioned to slide into the apertures 20, whereby the cover plate 18 removably covers the level indicator 16 to conceal the level indicator 16 from view. Other known means for affixing the cover plate to the frame are within the scope of the present invention.

Figure 3:
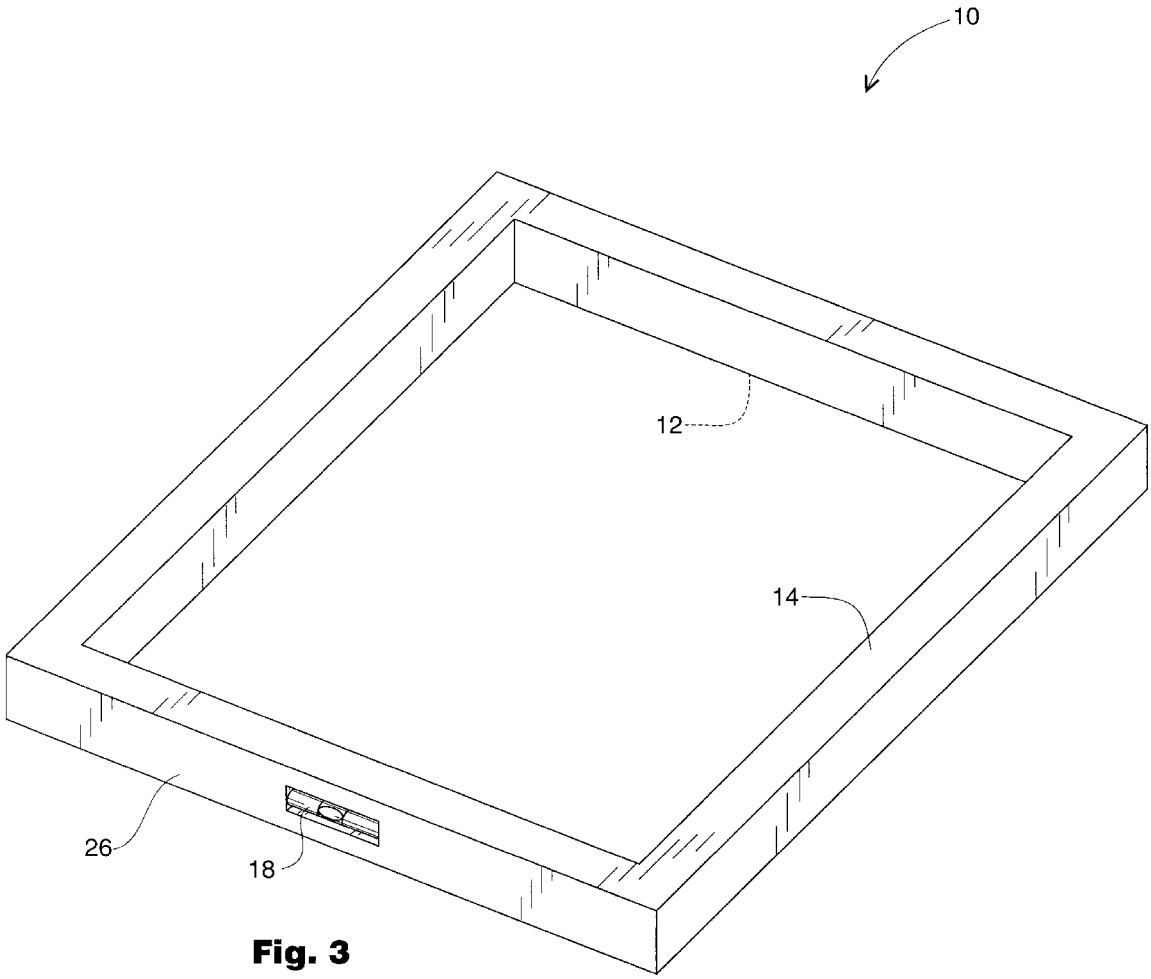
FIG. 3 is a perspective view of another embodiment of the invention.

FIG. 3 shows another embodiment of the present invention, in which the level indicator 16 is recessed in a bottom surface 26 of the frame 10. In this embodiment, the level indicator 16 is only visible by looking upward at the frame 10 from below the frame 10 when the frame 10 is hung on a wall. Because the level indicator 16 isn't normally visible when viewing the front surface 14 of the frame, no removable cover plate 18 is required for this embodiment of the invention.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A frame for holding and displaying picture and certificates, the frame comprising at least one frame member having a visual level indicator mounted within a recess within the frame member, a cover plate removably mounted to the frame member to completely conceal the visual level indicator from view.

2. The frame of claim 1, wherein the frame includes a hanging surface adapted to be adjacent a wall when the frame is hung, and a front surface generally opposite the hanging surface, and wherein the visual level indicator is positioned such that it is visible when viewing the front surface of the frame and the cover plate is removed.

* * * * *